US006828287B1

(12) United States Patent
Lakes et al.

(10) Patent No.: US 6,828,287 B1
(45) **Date of Patent: *Dec. 7, 2004**

(54) BIODEGRADABLE TWO-CYCLE ENGINE OIL COMPOSITIONS AND ESTER BASE STOCKS

(75) Inventors: Stephen C. Lakes, Cincinnati, OH (US); Henry G. Stoeppel, II, Cincinnati, OH (US); Bruce J. Beimesch, Crescent Springs, KY (US)

(73) Assignee: Cognis Corporation, Ambler, PA (US)

( * ) Notice: Subject to any disclaimer, the term of this patent is extended or adjusted under 35 U.S.C. 154(b) by 1430 days.

This patent is subject to a terminal disclaimer.

(21) Appl. No.: 08/896,060

(22) Filed: Jul. 17, 1997

Related U.S. Application Data

(63) Continuation of application No. 08/442,611, filed on May 17, 1995, now Pat. No. 6,664,216, which is a continuation of application No. 08/119,318, filed on Sep. 9, 1993, now abandoned, which is a continuation of application No. 07/937,625, filed on Aug. 28, 1992, now abandoned.

(51) Int. Cl.[7] ..... C10L 1/18

(52) U.S. Cl. ..... 508/485; 508/496; 44/388; 44/389

(58) Field of Search ..... 508/485, 496, 508/455, 463; 44/388, 389

(56) References Cited

U.S. PATENT DOCUMENTS

| | | | | | |
|---|---|---|---|---|---|
| 3,871,837 | A | * | 3/1975 | Bedague et al. | 44/389 |
| 4,061,581 | A | * | 12/1977 | Leleu et al. | 508/287 |
| 4,066,789 | A | * | 1/1978 | Mores et al. | 514/786 |
| 4,144,183 | A | * | 3/1979 | Koch et al. | 508/485 |
| 4,234,497 | A | | 11/1980 | Honig | |
| 4,708,809 | A | * | 11/1987 | Davis | 508/295 |
| 4,780,229 | A | * | 10/1988 | Mullin | 508/282 |
| 5,057,247 | A | * | 10/1991 | Schmid et al. | 508/481 |
| 5,994,278 | A | * | 11/1999 | Duncan et al. | 508/485 |
| 6,197,731 | B1 | * | 3/2001 | Zehler et al. | 508/485 |
| 6,664,216 | B1 | * | 12/2003 | Lakes et al. | 508/485 |

FOREIGN PATENT DOCUMENTS

| | | |
|---|---|---|
| JP | 52-61674 | 5/1977 |
| JP | 4-120195 | 4/1992 |

* cited by examiner

*Primary Examiner*—Cephia D. Toomer
(74) *Attorney, Agent, or Firm*—Aaron R. Ettelman

(57) ABSTRACT

Lubricant compositions comprising biodegradable ester base stocks are provided for water-cooled or air-cooled two-cycle engines.

31 Claims, No Drawings

BIODEGRADABLE TWO-CYCLE ENGINE OIL COMPOSITIONS AND ESTER BASE STOCKS

This is a continuation of application Ser. No. 08/442,611 filed May 17, 1995 now U.S. Pat. No. 6,664,216 which is a continuation of application Ser. No. 08/119,318, filed Sep. 9, 1993, now abandoned; which is a continuation of application Ser. No. 07/937,625 filed Aug. 28, 1992, now abandoned.

BACKGROUND OF THE INVENTION

1. Field of the Invention

The present invention relates to two-cycle engine oil compositions and to ester base stocks which are components thereof. The compositions of the invention require no miscibility-enhancing solvents and are readily biodegradable.

2. Description of the Related Art

The two-cycle (two stroke) engine has gained considerable popularity as a power source for such devices as outboard motors, snow mobiles, mopeds and a variety of landscaping equipment, e.g., lawnmowers, chain saws, string trimmers and blowers. The widespread use of two-cycle engines is due primarily to their simple design and lightweight construction, their ability to provide high power output with quick starts at low temperature and their relatively low cost.

Two-cycle engines are operated using a mixture of gasoline and a lubricant in prescribed proportions. The lubricant must provide satisfactory performance characteristics under severe operating conditions. Lubricants for two-cycle engines ar generally composed of a mineral oil or synthetic base fluid, performance additives and a solvent, ordinarily a relatively low boiling petroleum distillate, to enhance gasoline/lubricant miscibility.

The technologies developed to date for reducing exhaust emissions from four-cycle car and truck engines have not been successfully adapted to two-cycle engines. Hence, there is growing public concern over the high levels of hydrocarbon emissions from these small engines, as hydrocarbons do not readily biodegrade.

The hydrocarbon emissions are a consequence of the basic design of the engine. Specifically, in the power stroke of a typical two-cycle engine, air, oil and fuel are drawn into the crank case as the combined charge is compressed in the space above the piston. In the exhaust stroke, the burnt gases are discharged through exhaust ports, and a fresh combustible charge is transferred from the crank case to the space above the piston. Because the exhaust ports open before and close after transfer of the fresh combustible charge occurs, as much as 20% of the fresh charge will be discharged unburnt with the exhaust. Consequently, hydrocarbon emissions far exceed the level of emissions from a comparable four-cycle engine.

Water-cooled outboard motors exhaust directly into the water, giving rise to water pollution, whereas the other devices mentioned above, which are equipped with air-cooled two-cycle engines, produce emissions that pose a serious air pollution problem. For example, the California Air Research Board has determined that many two-cycle engines produce up to fifty times the pollution of truck engines per horsepower hour.

The above-noted pollution problems are exacerbated by the presence of volatile organic solvents in the lubricant.

Moreover, some of the solvents used as miscibility enhancers, such as Stoddard solvent, have relatively low flash points, thus creating a potential fire risk, which is of particular concern in connection with the storage and transportation of such products.

Thus, a need exists for a two-cycle engine oil composition which is formulated so as to prevent pollution by protecting against emission of harmful hydrocarbons into the environment, and to reduce the hazard potential of the solvent-containing lubricants, especially in storage and in transit. These objectives must be obtained, however, while simultaneously satisfying stringent performance standards, e.g., good lubricity and detergency, particularly on piston rings, superior anti-seizure properties and high gel/floc resistance, and providing optimum miscibility of lubricant and fuel over the applicable range of operating conditions.

SUMMARY OF THE INVENTION

In accordance with the present invention, there is provided a biodegradable ester base stock and a two-cycle engine oil composition containing same which is adapted for use in both water-cooled and air-cooled two-cycle engines. The oil composition of the invention is formulated so as to eliminate the need for a conventional solvent, thereby substantially reducing not only the pollution potential of two-cycle engines lubricated therewith, but the hazard risk inherent in solvent-containing formulations.

According to one embodiment of the present invention, there is provided an ester base stock for a two-cycle engine oil composition, which consists essentially of a blend of (a) a first polyol ester comprising, as its reactive components, a neopentylpolyol and a $C_{16}$–$C_{20}$ branched chain, saturated monocarboxylic acid, and (b) a second polyol ester comprising, as its reactive components, a neopentyl polyol and a carboxylic acid selected from the group consisting of at least one $C_5$–$C_{10}$ linear, saturated monocarboxylic acid, or at least one $C_{16}$–$C_{20}$ linear or branched chain, unsaturated monocarboxylic acid.

According to another embodiment of this invention, there is provided an ester base stock for a two-cycle engine oil composition, which consists essentially of a blend of (a) a first polyol ester comprising, as its reactive components, a neopentyl polyol and a $C_8$–$C_{10}$ linear, saturated monocarboxylic acid and (b) a second complex polyol ester comprising, as its reactive components, a neopentyl polyol, a $C_6$–$C_{12}$ dicarboxylic acid and a $C_5$–$C_{10}$ linear or branched chain, saturated monocarboxylic acid.

A solvent substitute, if desired, may optionally be incorporated in the ester base stocks of the invention. Suitable for this purpose are any of various relatively low molecular weight esters comprising as the reactive components thereof, a $C_8$–$C_{13}$ linear or branched chain monohydric alcohol and a $C_5$–$C_{12}$ linear or branched chain carboxylic acid.

The ester base stocks of the invention are characterized by their superior biodegradability, flash point and viscosity properties, as compared with two-cycle engine lubricant base stocks heretofore available. The biodegradability of the ester base stocks of the invention is greater than 80%, as determined by CEC-L-33-T-82. Each of the ester base stocks of the invention has a flash point of at least 175° C. The kinematic viscosity of the ester base stocks of the invention is less than 15 cSt at 100° C.

The two-cycle engine oil compositions of the invention are composed of the above-described base stocks and any of the performance additive packages known in the art, preferably ashless detergent/dispersant additives, e.g., reaction products of polyamines and relatively long chain fatty acids. In addition to having the desirable biodegradability, flash point and viscosity properties noted above, the two-cycle engine oil compositions of the invention have excellent miscibility with gasoline, in fuel/oil ratios between 16:1 to 100:1

DESCRIPTION OF THE PREFERRED EMBODIMENTS

A. Ester Base Stocks

Preferred two-cycle engine oil base stocks of the invention are blends consisting essentially of a first polyol ester formed by the reaction of a neopentyl polyol and a $C_{16}$–$C_{20}$ branched chain, saturated monocarboxylic acid and a second polyol ester formed by the reaction of a neopentyl polyol and a carboxylic acid selected from the group consisting of (i) at least one $C_5$–$C_{10}$ straight chain, saturated monocarboxylic acid or (ii) at least one $C_{16}$–$C_{20}$ straight or branched chain, unsaturated monocarboxylic acid.

Suitable neopentyl polyols for preparation of the ester blends described above include trimethylolethane, trimethylolpropane, ditrimethylolpropane, pentaerythritol, dipentaerythritol, neopentylglycol and mixtures of any two or more of such neopentyl polyols. Trimethylolpropane is particularly preferred as the neopentyl polyol reactant in both components of the preferred ester blend described immediately above.

The preferred acids which may be used to form the first polyol ester include the $C_{16}$–$C_{18}$ "isoacids", isostearic acid being particularly preferred. Isostearic acid is a readily available commercial product obtained as a by-product from the manufacture of polymer fatty acids by the polymerization of naturally-occurring, unsaturated $C_{18}$ fatty acids. It is obtainable under the trademark Emersol® 871 and Emersol® 875 from Henkel Corporation, Emery Group, Cincinnati, Ohio. By way of illustration of the preparation of polymeric fatty acids, reference may be had to U.S. Pat. Nos. 2,793,219 and 2,955,121. Polymeric fatty acids from the polymerization of unsaturated fatty acids are primarily composed of dimer and trimer acids; however, there may also be present in the mixture some higher acids and unreacted monomer. A portion of the $C_{18}$ monomer acid rearranges during the polymerization to yield a branched-chain $C_{18}$ is monocarboxylic acid product which is then isolated by distillation. Although the exact structure of this $C_{16}$ branched-chain product has not been fully elucidated, the principal components of the acid are methyl-branched isomers.

Isostearic acid prepared in the manner just described may contain up to 35% by weight saturated, and some unsaturated straight-chain $C_8$–$C_{18}$ fatty acids. Preferably, these straight chain acids will constitute 25% or less of the isostearic acid reactant. These straight-chain acids are typically present in the isostearic acid as obtained from the polymerization process, however, additional straight-chain acids may be blended with the isostearic acid so long as the aforementioned limit is not exceeded.

Acid component (i) of the second polyol ester in the preferred ester base stock described immediately above is preferably selected from the group of caproic acid, caprylic acid, pelargonic acid, capric acid and mixtures of two or more of such straight chain, saturated monocarboxylic acids. Particularly preferred as acid component (i) of the second polyol ester are pelargonic acid, or a blend of caprylic ($C_8$) and capric ($C_{10}$) acids, the latter being commercially available under the trademark Emery® 658 from Henkel Corporation, Emery Group, Cincinnati, Ohio. Mixtures of relatively low molecular weight fatty acids (e.g., Emery® 1210) may also be used as acid component (i), if desired.

Acid component (ii) of the second polyol ester described is preferably selected from the group of palmitoleic acid, oleic acid and mixtures of such unsaturated monocarboxylic acids. Oleic acid is particularly preferred as acid component (ii).

The ester base stock blends of the present invention are prepared using conventional mixing equipment and techniques. In general, the amount of the first polyol ester in the preferred ester base stock described immediately above should be from about 10% to about 65%, based on the total weight of the ester base stock, and the amount of the second polyol ester present in the blend should be from about 35% to about 90% based on the total weight of the base stock.

Other preferred ester base stocks according to this invention are blends consisting essentially of a first polyol ester formed by the reaction of a neopentyl polyol and a $C_8$–$C_{10}$ straight chain, saturated monocarboxylic acid and a second, complex polyol ester formed by the reaction of a neopentyl polyol, a $C_6$–$C_{12}$ dicarboxylic acid and a $C_5$–$C_{10}$ straight or branched chain saturated monocarboxylic acid.

The preferred neopentylpolyols used in forming the ester base stock of these alternative embodiments of the present invention are essentially the same as those previously described hereinabove. In this embodiment also, TMP is the most preferred neopentylpolyol.

The preferred acid component of the first polyolester of these alternative embodiments includes pelargonic acid or a blend of caprylic and capric acids (e.g., Emery® 658), pelargonic acid (e.g., Emery® 1202) being particularly preferred.

The complex polyol esters used in preparing the last-mentioned base stocks of the invention are preferably prepared using a blend of caprylic and capric acids (e.g., Emery® 658) as the monocarboxylic acid and adipic acid as the dicarboxylic acid components of the complex ester, typically in a weight ratio from about 2.5:1.0 to about 3.0:1.0, caprylic acid-capric acid to adipic acid.

Generally, the amount of the first polyol ester in the ester base stock of these alternative embodiments should be from about 25% to about 85%, based on the total weight of the base stock and the amount of the second polyol ester component should be from about 15% to about 75%, based on the total weight of the base stock.

The above-described ester base stocks may be prepared from relatively pure reagents or from technical grade reagents, e.g., mixed polyols or mixed acids, the reagent mixtures being more economical, because commercially available products may be used, without costly purification as a prerequisite.

The above-described esters are prepared utilizing conventional esterification procedures. Typically, the quantity of acid charged to the reaction mixture initially is sufficient to provide an excess of about 1.1–1.2% of equivalents of acid over the equivalents of alcohol reacted therewith. An equivalent of acid is defined for the purposes of this specification as the amount containing 1 gram equivalent weight of carboxyl groups, whereas an equivalent of alcohol is the amount containing 1 gram equivalent weight of hydroxyl groups. If the reaction mixture contains both monovalent and divalent acids, the excess preferably is made up of the monovalent acid. The esterification reaction is carried out at elevated temperature while removing water. The reaction may be carried out by refluxing the reactants in an azeotropic solvent, such as toluene or xylene, to facilitate removal of water. Esterification catalysts may be used, but are not necessary for the reaction. Upon completion of the reaction, excess acid and any solvent may be conveniently separated from the ester product by vacuum stripping or distillation.

The ester product thus produced may be utilized as such, or it may be alkali refined or otherwise treated to reduce the acid number, remove catalyst residue, reduce ash content, or other undesired impurities. If the ester product is subject to alkali refining, the resultant product should be washed with water to remove any unreacted excess alkali and the small amount of soap form from the excess fatty acid neutralized by the alkali before using the ester as a base stock and/or lubricant according to this invention.

The ester base stocks of the present invention may optionally include a relatively low molecular weight ester, if desired, as a solvent substitute to enhance fuel/oil miscibility. The solvent substitute-ester may be formed from the reaction of a monohydric alcohol selected from octanol, nonanol, decanol, undecanol, dodecanol, tridecanol and branched chain isomers thereof, and a carboxylic acid selected from the group of valeric acid, caproic acid, enanthic acid, caprylic acid, pelargonic acid, capric acid, undecylic acid, lauric acid and branched chain isomers thereof.

B. Two-Cycle Oil Compositions

Various detergent/dispersant additive packages may be combined with the above-described ester base stocks in formulating the two-cycle oil compositions of the invention. Ashless or ash-containing additives may be used for this purpose, ashless additives being preferred.

Suitable ashless additives include polyamide, alkenylsuccinimides, boric acid-modified alkenylsuccinimides, phenolic amines and succinate derivatives or combinations of any two or more of such additives.

Polyamide detergent/dispersant additives, such as the commonly used tetraethylenepentamine isostearate, may be prepared by the reaction of fatty acid and polyalkylene polyamines, as described in U.S. Pat. No. 3,169,980, the entire disclosure of which is incorporated by reference in this specification, as if set forth herein in full. These polyamides may contain measurable amounts of cyclic imidazolines formed by internal condensation of the linear polyamides upon continued heating at elevated temperature. Another useful class of polyamide additives is prepared from polyalkylene polyamines and $C_{19}$–$C_{25}$ Koch acids, according to the procedure of R. Hartle et al., JAOCS, 57 (5): 156–59 (1980).

Alkenylsuccinimides are formed by a step-wise procedure in which an olefin, such as polybutene ($\overline{MW}$ 1200) is reacted with maleic anhydride to yield a polybutenyl succinic anhydride adduct, which is then reacted with an amine, e.g., an alkylamine or a polyamine, to form the desired product.

Phenolic amines are prepared by the well-known Mannich reaction (C. Mannich and W. Krosche, Arch. Pharm., 250: 674 (1912)), involving a polyalkylene-substituted phenol, formaldehyde and a polyalkylene polyamine.

Succinate derivatives are prepared by the reaction of an olefin (e.g., polybutene ($\overline{MW}$ 1200 700–300)) and maleic anhydride to yield a polybutenyl succinic anhydride adduct, which undergoes further reaction with a polyol, e.g., pentaerythritol, to give the desired product.

Suitable ash-containing detergent/dispersant additives include alkaline earth metal (e.g., magnesium, calcium, barium), sulfonates, phosphonates or phenates or combinations of any two or more of such additives.

The foregoing detergent/dispersant additives may be incorporated in the lubricant compositions described herein in an amount from about 5 to about 20%, and more preferably from about 10% to about 16% based on the total weight of the composition.

Various other additives may be incorporated in the lubricant compositions of the invention, as desired. These include smoke-suppression agents, such as polyisobutylene, extreme pressure additives, such as dialkyldithiophosphoric acid salts or esters, anti-foaming agents, such as silicone oil, pour point depressants, such as polymethacrylate, rust or corrosion prevention agents, such as triazole derivatives, propyl gallate or alkali metal phenolates or sulfonates, oxidation inhibitors, such as substituted diarylamines, phenothiazines, hindered phenols, or the like. Certain of these additives may be multifunctional, such as polymethacrylate, which may serve as an anti-foaming agent, as well as a pour point depressant.

These other additives may be incorporated in the lubricant composition in an amount from about 0.01% to about 15%, and preferably from about 0.01% to about 6%, based on the total weight of the lubricant composition. The amount selected within the specified range should be such as not to adversely effect the desirable performance properties of the lubricant. The effects produced by such additives can be readily determined by routine testing.

The biodegradability of the ester base stocks/lubricant compositions of this invention is ≧80%, as determined by Co-ordinating European Counsel standard test method L-33-T-82 (Biodegradability of Two-Stroke Cycle Outboard Engine Oils in water), which provides a procedure to evaluate comparatively the biodegradability of two-cycle outboard engine lubricants against the biodegradability of standard calibration materials. In performing this test procedure, test flasks containing a mineral medium, the test oil and a bacterial inoculum (effluent from a municipal sewage plant), together with flasks containing poisoned blanks, are incubated for 0 to 21 days. Flasks containing calibration oils are run in parallel. The tests are carried out in triplicate at 25±1° C. and in darkness.

At the end of the incubation period the contents of the flasks are subjected to sonic vibration, acidified and extracted with carbon tetrachloride or 1,1,2-trichlorotrifluoroeathane. The extracts are then analyzed by infra-red spectroscopy, measuring the maximum adsorption of the CH3—CH2-bond at 2930 $cm^{-1}$.

Biodegradability is expressed in % as the difference in residual oil contents between the poisoned flasks and the respective test flasks.

Details of reference and standardization lubricants are to be found in the CEC Handbook of Reference/Standardization Oils for Engine/Rig Tests.

The biodegradability of the ester base stocks of the invention is preferably ≧90%, as determined by the same CEC standard test method mentioned above. A biodegradability value below 80% for the ester base stocks, according to the aforementioned CEC standard test method, is not considered to be readily biodegradable.

The ester base stocks/lubricant compositions of the invention have a flash point of ≧175° C., and preferably ≧250° C. Such flash point properties are a decided improvement over prior art ester base stocks containing miscibility enhancing solvents, such as Stoddard solvent, which has a flashpoint of about 40° C.

The ester base stocks/lubricant compositions of the invention have desirably low viscosities of less than 15 cSt at 100° C. Preferably, the viscosity at 100° C. is in the range of 7–9 cSt. At viscosities much above 15 cSt at 100° C., the corresponding viscosity at −25° C. is such that the miscibility of the ester base stock/lubricant in gasoline is reduced.

The miscibility of the two-cycle engine oil composition of the invention with gasoline, in a fuel/oil ratio of 16:1 to 100:1 is generally ≦110% relative to a reference oil, as determined by ASTM-4682 using Citgo-93738 as the reference oil for category 3, as outlined in SAE J1536.

The two-cycle engine oil compositions of the present invention are particularly suited, when mixed with an appropriate fuel, for operating outboard motors, snow mobiles, mopeds, lawnmowers, chain saws, string trimmers and the like.

The following examples describe specific ester base stocks and lubricant compositions embodying the present invention. The base stocks and compositions exemplified below represent the best mode presently contemplated by the inventors for practicing this invention. These examples are provided for illustrative purposes only and are not intended to limit the scope of the invention in any way.

EXAMPLE 1

A solvent-free biodegradable ester base stock blend, according to the present invention, was prepared from trimethylolpropane triisostearate (about 42 weight percent) and trimethylolpropane tripelargonate (about 58 weight percent). The resultant blend has the typical characteristics listed below in Table I, which also identifies the method by which the specified characteristics were determined.

TABLE I

| Properties | Characteristics | Methods |
|---|---|---|
| Viscosity, cSt | | ASTM D-445 |
| 100° C. | 6.9 | |
| 40° C. | 37.1 | |
| Viscosity Index | 148 | ASTM D-2270 |
| Viscosity, SUS | | ASTM D-2161 |
| 210° F. | 49.5 | |
| 100° F. | 188.9 | |
| Viscosity, cp | | ASTM D-2983 |
| −25° C. | 2425 | |
| Flash Point, ° C. | 265 | ASTM D-92 |
| Pour Point, ° C. | −37 | ASTM D-97 |
| Acid Value, mg KOH/gm | 0.7 | ASTM D-974 |
| Hydroxyl Value mg KOH/gm | 2.5 | Emery 116.02 |
| Noack Volatility, % Loss | 2.2 | CEC-L-40-T-87 |
| Biodegradability | Readily Biodegradable* | CEC-L-33-T-82 |
| Specific Gravity, 60/60° F. | 0.9319 | ASTM D-1296 |
| Density, lbs./gal. @60° F. (15.6° C.) | 7.76 | |

*Greater than 80% according to CEC-L-33-T-82 Standard Test Method

Ester base stocks having characteristics generally similar to those reported in Table I may be obtained when about 20 to about 60 weight percent of trimethylolpropane triisostearate is blended with about 40 to about 80 weight percent of trimethylolpropane tripelargonate.

A two-cycle engine oil composition having outstanding overall performance properties was prepared by combining 85 weight percent of the specific ester base stock blend described herein and 15 weight percent of an ashless detergent/dispersant additive, available from Lubrizol® Corp. under the name Lubrizol® 400 Additive System.

The typical characteristics of the resultant lubricant composition and the standards by which these characteristics were evaluated are set forth below in Table II.

TABLE II

| Properties | Characteristics | Methods |
|---|---|---|
| Viscosity, cSt | | ASTM D-445 |
| 100° C. | 9.04 | |
| 40° C. | 55.5 | |
| Viscosity Index | 143 | ASTM D-2270 |
| Flash point, ° C. | 257 | ASTM D-92 |
| Pour Point, ° C. | −36 | ASTM D-97 |
| Noack Volatility, % Loss | 4.7 | CEC-L-40-87T |
| Acid Value, mg KOH/gm | 0.59 | ASTM D-974 |
| Hydroxyl Value, mg KOH/mg | 8.0 | AOCS Cd 13-60 |
| Color, G | 12 | AOCS Td 1a-64T |
| TBN, mg KOH/mg | 2.94 | ASTM D-2896 |
| % Nitrogen | 0.16 | ASTM D-3228 |
| Chlorine, ppm | 6 | ASTM D-1317 |
| Biodegradability | ≧80% | CEC-L-33-T-82 |

The specific lubricant composition described herein has been certified TC-W3™ by the National Marine Manufacturers Association (NMMA), following successful completion of certification testing procedures at the Southwest Research Institute. These test procedures and the results obtained are summarized below in Table III.

TABLE III

| A. Bench Tests | Results Candidate (Ref.)/ Evaluation | Test Method Evaluation Criteria |
|---|---|---|
| Cloud Point, ° C. | −29 | ASTM D-2500 |
| Compatability | Clear | Homogeneous after mixed separately with each reference oil *,**) and stored 48 hours |
| Brookfield (Fluidity) cp | | ASTM D-2983 |
| @ −25° C. | 5130/Pass | Less than 7500 cp |
| Miscibility | | ASTM D-4682 |
| (Inversions @ −25° C.) | 75(95)/Pass | No more than 10% more inversions than reference (*) |
| Rust Test, % | 3.16(4.04)/Pass | NMMA Procedure Equal to or better than reference (*) |
| Filterability, % Change | +6.5/Pass +6.5/Pass | NMMA Procedure Decrease in flow not greater than 20% |

| B. Engine Tests | Results Candidate (Ref.)/ Evaluation | Evaluation Criteria |
|---|---|---|
| 1. OMC Engine Tests | | |
| 40 Horsepower Tests (98 Hours) | | |
| Avg. Piston Varnish | 9.2(8.9)/Pass | Not lower than 0.6 below same ratings of reference (*) |
| Top Ring Stick | 10.0(9.5)/Pass | |

TABLE III-continued

| | | |
|---|---|---|
| 70 Horsepower Test (100 Hours) | | |
| Avg. Piston Deposits | 6.5(5.0)/Pass | Equal to or better than same ratings of reference (***) |
| Second Ring Stick | 9.6(7.6)/Pass | |
| 2. Mercury 15 Horsepower Test 100 Hours | | |
| Scuffing | PASS | 100 Hours with no stuck rings, plus: a) scuffing within allowable limits (30%) |
| | PASS | |
| Bearing Stickiness | PASS | b) Needles must fall easily from wrist pin |
| Compression Loss | PASS | c) 20 psi maximum compression loss (reference (***) run every 5 candidate run(s) |
| Overall Evaluation | PASS | |
| 3. Yamaha Engine Test | | |
| CE50S Tightening/ Lubricity Test | | |
| Torque Drop, lb-in | 5.18(5.43)/ PASS | Equal to or better than reference (**) within 90% confidence level |
| CE50S Preignition Test (100 Hours) | | |
| Major Preignitions | 1(1)/PASS | Equal to or better than reference (*) |

*Citgo-93738 (TC-W II reference oil)
**XPA-3259
***OR-71591

EXAMPLE 2

A solventless, biodegradable ester base stock and lubricant composition, having characteristics similar to those reported in Example 1, above, was prepared by replacing the trimethylolpropane tripelargonate of Example 1 with an ester formed from trimethylolpropane and a mixture of caprylic acid and capric acid (Emery® 658). Particularly good properties are exhibited by an ester blend composed of 49 weight percent of trimethylolpropane triisostearate and 51% of the replacement ester.

Ester base stocks having similar characteristics may be obtained from a blend of about 15 to about 55 weight percent trimethylolpropane triisostearate and about 45 to about 85 weight percent of the ester formed from trimethylolpropane and the caprylic-capric acid mixture.

A two-cycle engine oil composition was prepared from the specific ester base stocks described herein and the same additive system in the same relative amounts used in Example 1, above. Fuel-oil mixtures containing the specific lubricant composition described herein exhibited good miscibility according to ASTM D-4682.

EXAMPLE 3

A solventless, biodegradable base stock was prepared from trimethylolpropane triisostearate (about 75 weight percent) and trimethylolpropane trioleate (about 25 weight percent). The ester base stock thus obtained has the characteristics set forth below in Table IV

TABLE IV

| Properties | Characteristics | Methods |
|---|---|---|
| Viscosity, cSt | | ASTM D-45 |
| 100° C. | 13.22 | |
| 40° C. | 88.89 | |
| Viscosity, cp | | ASTM D-2983 |
| −25° C. | 26,700 | |
| Viscosity Index | 149 | ASTM D-2270 |
| Flash Point, ° C. | 293 | ASTM D-92 |
| Pour Point, ° C. | −28 | ASTM D-97 |
| Biodegradability | >90% | CEC L-33-T-82 |

Ester base stocks exhibiting properties generally similar to those reported in Table IV, above, may be obtained from a blend of about 35 to about 90 weight percent of trimethlolpropane triisostearate and about 10 to about 65 weight percent of trimethylolpropane trioleate.

A two-cycle engine oil composition was prepared from the specific ester base stock described herein and the same additive system in the same relative amounts used in Example 1, above. Fuel-oil mixtures containing the specific lubricant composition described herein exhibited good miscibility, remaining according to ASTM D-4682.

EXAMPLE 4

A solventless, biodegradable ester base stock having desirable biodegradable, flash point and viscosity properties was blended from about 0.55 weight percent of trimethylolpropane triisostearate and about 45 weight percent of an ester comprising, as its reactive components, trimethylolpropane and a mixture of $C_5$-$C_9$ straight chain saturated monocarboxylic acids (Emery® 1210 LMW Acid). Ester base stocks having similar biodegradability, flash point and viscosity properties may be obtained from a blend of about 35 to 70 weight percent of trimethylolpropane triisostearate and from about 30 to about 65 weight percent of an ester formed by the reaction of trimethylolpropane and the aforementioned mixture of $C_5$–$C_9$ saturated monocarboxylic acids.

A two-cycle engine oil composition was prepared from the specific ester base stock described herein and the same additive system used in Example 1. The resultant lubricant composition had a viscosity of less than 10 cSt at 100° C. and exhibited satisfactory miscibility with commercial two-cycle engine fuels.

EXAMPLE 5

A series of ester base stocks was prepared by blending trimethylolpropane tripelargonate and a complex ester formed by the reaction of trimethylolpropane, a caprylic-capric acid mixture (Emery® 658) and adipic acid in varying proportions ranging from about 25 to about 85% of the trimethylolpropane tripelargonate and from 15 to about 75 weight percent of the complex ester, as follows:

| Ex. No. | 5(a) | 5(b) | 5(c) | 5(d) | 5(e) |
|---|---|---|---|---|---|
| wt % Complex ester | 15.0 | 26.2 | 31.0 | 43.0 | 52.7 |
| wt % TMP-tripelargonate | 85.0 | 73.8 | 69.0 | 57.0 | 47.3 |

Certain characteristics of the specific blends are reported in Table V, which also lists the methods by which the specified characteristics were determined.

Although the various aspects of the present invention have been described and exemplified above in terms of certain preferred embodiments, various other embodiments may be apparent to those skilled in the art. The invention is, therefore, not limited to the embodiments specifically described and exemplified herein, but is capable of variation and modification without departing from the scope of the appended claims.

TABLE V

| Property | Characteristics 5(a) | 5(b) | 5(c) | 5(d) | 5(e) | Methods |
|---|---|---|---|---|---|---|
| Viscosity, cSt | | | | | | |
| 100° C. | 6.02 | 7.47 | 8.03 | 10.02 | 11.99 | ASTM D-445 |
| 40° C. | 29.89 | 39.4 | 43.86 | 60.60 | 76.11 | — |
| −25° C., cp | 1706 | — | 4440 | 7248 | 9060 | ASTM D-2983 |
| Viscosity Index | 153 | 159 | 158 | 152 | 154 | ASTM D-2270 |
| Cloud Point ° F. | −70 | — | −75 | C1/pour | C1/pour | ASTM D-2500 |
| Pour Point ° F. | −65 | — | −65 | −65 | −65 | ASTM D-97 |
| Flash Point ° F. | 500 | 505 | 505 | 515 | 515 | ASTM D-92 |
| Sp. Gr. 60° F. | .9558 | — | .9663 | — | .9805 | ASTM D-1298 |

What is claimed is:

1. An ester base stock for a two-cycle engine oil composition, said base stock consisting essentially of a blend of (a) a first polyol ester comprising, as its reactive components, a neopentylpolyol and a $C_{16}$–$C_{20}$ branched chain, saturated monocarboxylic acid and (b) a second polyol ester comprising, as its reactive components, a neopentylpolyol and a carboxylic acid selected from the group consisting of at least one $C_5$–$C_{10}$ straight chain, saturated monocarboxylic acid, or at least one $C_{16}$–$C_{20}$ straight or branched chain, unsaturated monocarboxylic acid; and, optionally, a relatively low molecular weight ester comprising, as its reactive components, a $C_8$–$C_{13}$ straight or branched chain monohydric alcohol and a $C_5$–$C_{12}$ straight or branched chain carboxylic acid, said ester base stock having the following characteristics:

(i) biodegradability of ≧80%, as determined by CEC-L-33-T-82;

(ii) flash point of ≧175° C.; and (iii) kinematic viscosity of less than 15 cSt at 100° C.

2. An ester base stock as claimed in claim 1, wherein the neopentylpolyol component of said first and said second ester is selected from the group consisting of trimethylolpropane, pentaerythritol, ditrimethylolpropane, dipentaerythritol, neopentylglycol, trimethylolethane and mixtures of two or more of said neopentylpolyols.

3. An ester base stock as claimed in claim 2, wherein the acid component of said first ester is isostearic acid, and the acid component of said second ester is selected from (i) the group consisting of caproic acid, caprylic acid, pelargonic acid, capric acid, and mixtures of two or more of said straight chain, saturated monocarboxylic acids, or (ii) the group consisting of palmitoleic acid, oleic acid, and mixtures of said unsaturated monocarboxylic acids.

4. An ester base stock as claimed in claim 1, consisting essentially of from about 10% to about 65% of said first ester and from about 35% to about 90% of said second ester, based on the weight of said ester base stock.

5. An ester base stock for a two-cycle engine oil composition, consisting essentially of from about 35% to about 70% of trimethylolpropane triisostearate and from about 30% to about 65% of an ester formed by the reaction of trimethylolpropane and a mixture of $C_5$–$C_9$ saturated monocarboxylic acids, based on the weight of said ester base stock.

6. An ester base stock as claimed in claim 5, consisting essentially of about 55% trimethylolpropane triisostearate and about 45% of an ester formed by the reaction of trimethylolpropane and a mixture of $C_5$–$C_9$ straight chain saturated monocarboxylic acids, based on the weight of said ester base stock.

7. A biodegradable two-cycle engine oil composition comprising:

(A) an ester base stock consisting essentially of a blend of (a) a first polyolester comprising, as its reactive components, a neopentylpolyol and a $C_{16}$–$C_{20}$ branched chain saturated monocarboxylic acid and (b) a second polyol ester comprising, as its reactive components, a neopentylpolyol and a carboxylic acid selected from the group consisting of at least one $C_5$–$C_{10}$ straight chain, saturated monocarboxylic acid or at least one $C_{16}$–$C_{20}$ straight or branched chain, unsaturated monocarboxylic acids; and, optionally, a relatively low molecular weight ester comprising, as its reactive components, a $C_8$–$C_{13}$ straight or branched chain monohydric alcohol and a $C_5$–$C_{12}$ straight or branched chain carboxylic acid, said ester base stock having the following characteristics:

(i) biodegradability of ≧80%, as determined by CEC-L-33-T-82;

(ii) flash point of ≧175° C.; and (iii) kinematic viscosity of less than 15 cSt at 100° C.; and (B) a detergent/dispersant additive, said composition having the following characteristics:

(i) biodegradability of ≧80%, as determined by CEC-L-33-T-82;

(ii) flash point of ≧175° C.;

(iii) kinematic viscosity of less than 15 cSt at 100° C.; and (iv) miscibility with gasoline, in a fuel/oil ratio of 16:1 to 100:1, of ≦110% of reference oil, as determined by ASTM-4682, using Citgo-93738 as said reference oil for category 3, according to SAE J1536.

8. A biodegradable two-cycle engine oil composition, as claimed in claim 7, wherein said additive is selected from the group consisting of a polyamide, a alkenylsuccinimide, a boric acid-modified alkenylsuccinimide, a phenolic amine, a succinate derivative or a combination of any two or more of said additives.

9. A biodegradable two-cycle engine oil composition, as claimed in claim 7, wherein said additive is selected from the group consisting of sulfonate phosphonate, an alkaline earth metal, phenate, or a combination of any two or more of said additives.

10. A biodegradable two-cycle engine oil composition as claimed in claim 7, comprising from about 80% to about 90% of said ester base stock and from about 10% to about 20% of said additive, based on the weight of said composition.

11. A biodegradable two-cycle engine oil composition, as claimed in claim 8, comprising about 85% of an ester base stock consisting essentially of trimethylolpropane triisostearate and an ester formed by the reaction of trimethlolpropane and a mixture of $C_5$–$C_9$ straight chain saturated monocarboxylic acids, in a weight ratio of about 1.2:1.0, and about 15% of said additive, said percentages being based on the weight of said composition.

12. An ester base stock for a two-cycle engine oil composition, said base stock consisting essentially of a blend of (a) a first polyol ester comprising, as its reactive components, a neopentylpolyol and a $C_8$–$C_{10}$ straight chain, saturated monocarboxylic acid and (b) a second complex polyol ester comprising, as its reactive components, a neopentylpolyol, a $C_6$–$C_{12}$ dicarboxylic acid and a $C_5$–$C_{10}$ straight or branched chain, saturated monocarboxylic acid; and, optionally, a relatively low molecular weight ester comprising, as its reactive components, a $C_8$–$C_{13}$ straight or branched chain monohydric alcohol and a $C_5$–$C_{12}$ straight or branched chain carboxylic acid, said ester base stock having the following characteristics:

(i) biodegradability of ≧80%, as determined by CEC-L-33-T-82;

(ii) flash point of ≧175° C.; and (iii) kinematic viscosity of less than 15 cSt at 100° C.

13. An ester base stock as claimed in claim 12, wherein the neopentylpolyol component of said first and said second ester is selected from the group consisting of trimethylolpropane, pentaerythritol, ditrimethylolpropane, dipentaerythritol, neopentylglycol, trimethylolethane and mixtures of two or more of said neopentylpolyols.

14. An ester base stock as claimed in claim 12, consisting essentially of from about 25% to about 85% of said first ester and from about 15% to about 75% of said second ester, based on the weight of said ester base stock.

15. An ester base stock as claimed in claim 14, consisting essentially of about 85% of trimethylolpropane tripelargonate and about 15% of a complex polyol ester comprising, as its reactive components, trimethylolpropane, and an acid mixture consisting essentially of caprylic acid and capric acid, and adipic acid, the weight ratio thereof being in a range from about 2.5:1.0 to 3.0:1.0, caprylic acid-capric acid to adipic acid, said percentages being based on the weight of said ester base stock.

16. An ester base stock as claimed in claim 14, consisting essentially of about 75% trimethylolpropane tripelargonate and about 25% of a complex polyol ester comprising, as its reactive components, trimethylolpropane, and an acid mixture consisting essentially of caprylic acid and capric acid, and adipic acid, the weight ratio thereof being in a range from about 2.5:1.0 to 3.0:1.0, caprylic acid-capric acid to adipic acid, said percentages being based on the weight of said ester base stock.

17. An ester base stock as claimed in claim 14, consisting essentially of about 70% trimethylolpropane tripelargonate and about 30% of a complex polyol ester comprising, as its reactive components, trimethylolpropane, and an acid mixture consisting essentially of caprylic acid and capric acid, and adipic acid, the weight ratio thereof being in a range from about 2.5:1.0 to 3.0:1.0, caprylic acid-capric acid to adipic acid, said percentages being based on the weight of said ester base stock.

18. An ester base stock as claimed in claim 14, consisting essentially of about 55% trimethylolpropane tripelargonate and about 45% of a complex polyol ester comprising, as its reactive components, trimethylolpropane, and an acid mixture consisting essentially of caprylic acid and capric acid, and adipic acid, the weight ratio thereof being in a range from about 2.5:1.0 to 3.0:1.0, caprylic acid-capric acid to adipic acid, said percentages being based on the weight of said ester base stock.

19. An ester base stock as claimed in claim 14, consisting essentially of about 45% trimethylolpropane tripelargonate and about 55% of a complex polyol ester comprising, as its reactive components, trimethylolpropane, and an acid mixture consisting essentially of caprylic acid and capric acid, and adipic acid, the weight ratio thereof being in a range from about 2.5:1.0 to 3.0:1.0, caprylic acid-capric acid to adipic acid, said percentages being based on the weight of said ester base stock.

20. A biodegradable two-cycle engine oil composition comprising:

(A) an ester base stock consisting essentially of a blend of (a) a first polyol ester, comprising, as its reactive components, a neopentylpolyol and a $C_8$–$C_{10}$ straight chain, saturated monocarboxylic acid and (b) a second complex polyol ester comprising, as its reactive components, a neopentylpolyol, a $C_6$–$C_{12}$ dicarboxylic acid and a $C_5$–$C_{10}$ straight or branched chain, saturated monocarboxylic acid; and, optionally, a relatively low molecular weight ester comprising, as its reactive components, a $C_8$–$C_{13}$ straight or branched chain monohydric alcohol and a $C_5$–$C_{12}$ straight or branched chain carboxylic acid, said ester base stock having the following characteristics:

(i) biodegradability of ≧80%, as determined by CEC-L-33-T-82;

(ii) flash point of ≧175° C.; and (iii) kinematic viscosity of less than 15 cSt at 100° C.; and (B) a detergent/dispersant additive, said composition having the following characteristics:

(i) biodegradability of ≧80%, as determined by CEC-L-33-T-82;

(ii) flash point of ≧175° C.;

(iii) kinematic viscosity of less than 15 cSt at 100° C.; and (iv) miscibility with gasoline, in a fuel/ratio of 16:1 to 100:1, of ≦110% of reference oil, as determined by ASTM-4682, using Citgo-93738 as said reference oil for category 3, according to SAE J1536.

21. A biodegradable two-cycle engine oil composition, as claimed in claim 20, wherein said additive is selected from the group consisting of a polyamide, an alkenylsuccinimide, a boric acid-modified alkenylsuccinimide, a phenolic amine, a succinate derivative or a combination of any two or more of said additives.

22. A biodegradable two-cycle engine oil composition, as claimed in claim 20, wherein said additive is selected from the group consisting of sulfonate phosphonate, an alkaline earth metal, phenate, or a combination of any two or more of said additives.

23. A biodegradable two-cycle engine oil composition as claimed in claim 20, comprising from about 80% to about 90% of said ester base stock and from about 10% to about 20% of said additive, based on the weight of said composition.

24. A biodegradable two-cycle engine oil composition, as claimed in claim 21, comprising about 85% of an ester base stock consisting essentially of a blend of trimethylolpropane tripelargonate and a complex polyol ester comprising, as its reactive components, trimethylolpropane and an acid mixture consisting essentially of caprylic acid and capric acid, and adipic acid, the weight ratio of acid components of said complex ester being in a range from about 2.5:1.0 to 3.0:1.0 caprylic acid-capric acid to adipic acid, and the weight ratio of simple to complex esters in said blend being about 1.0:0.18, and about 15% of said additive, said percentages being based on the weight of said composition.

25. A biodegradable two-cycle engine oil composition, as claimed in claim 21, comprising about 85% of an ester base stock consisting essentially of a blend of trimethylolpropane tripelargonate and a complex polyol ester comprising, as its reactive components, trimethylolpropane and an acid mixture consisting essentially of caprylic acid and capric acid, and adipic acid, the weight ratio of acid components of said complex ester being in a range from about 2.5:1.0 to 3.0:1.0 caprylic acid-capric acid to adipic acid, and the weight ratio of simple to complex esters in-said blend being about 1.0:0.35, and about 15% of said additive, said percentages being based on the weight of said composition.

26. A biodegradable two-cycle engine oil composition, as claimed in claim 21, comprising about 85% of an ester base stock consisting essentially of a blend of trimethylolpropane tripelargonate and a complex polyol ester comprising, as its reactive components, trimethylolpropane and an acid mixture consisting essentially of caprylic acid and capric acid, and adipic acid, the weight ratio of acid components of said complex ester being in a range from about 2.5:1.0 to 3.0:1.0 caprylic acid-capric acid to adipic acid, and the weight ratio of simple to complex esters in said blend being about 1.0:0.45, and about 15% of said additive, said percentages being based on the weight of said composition.

27. A biodegradable two-cycle engine oil composition, as claimed in claim 21, comprising about 85% of an ester base stock consisting essentially of a blend of trimethylolpropane tripelargonate and a complex polyol ester comprising, as its reactive components, trimethylolpropane and an acid mixture consisting essentially of caprylic acid and capric acid, and adipic acid, the weight ratio of acid components of said complex ester being in a range from about 2.5:1.0 to 3.0:1.0 caprylic acid-capric acid to adipic acid, and the weight ratio of simple to complex esters in said blend being about 1.0:0.80, and about 15% of said additive, said percentages being based on the weight of said composition.

28. A biodegradable two-cycle engine oil composition, as claimed in claim 21, comprising about 85% of an ester base stock consisting essentially of a blend of trimethylolpropane tripelargonate and a complex polyol ester comprising, as its reactive components, trimethylolpropane and an acid mixture consisting essentially of caprylic acid and capric acid, and adipic acid, the weight ratio of acid components of said complex ester being in a range from about 2.5:1.0 to 3.0:1.0 caprylic acid-capric acid to adipic acid, and the weight ratio of simple to complex esters in said blend being about 1.0:1.2, and about 15% of said additive, said percentages being based on the weight of said composition.

29. A method of lubricating a two-cycle engine which comprises bringing the components of said engine which are to be lubricated into contact with an effective amount of the composition of claim 7.

30. A method of lubricating a two-cycle engine which comprises bringing the components of said engine which are to be lubricated into contact with an effective amount of the composition of claim 20.

31. A method as claimed in claim 30, wherein said engine is lubricated with a composition comprising about 85% of an ester base stock consisting essentially of a blend of trimethylolpropane triisostearate and trimethylolpropane tripelargonate, in a weight ratio of about 0.7:1.0, and about 15% of an ashless detergent/dispersant additive selected from the group consisting of a polyamide, an alkenylsuccinimide, a boric acid-modified alkenylsuccinimide, a phenolic amine, a succinate derivative, and a combination of said additives, said percentages being based on the weight of said composition.

* * * * *